US010551783B2

(12) United States Patent
Nagaya

(10) Patent No.: US 10,551,783 B2
(45) Date of Patent: Feb. 4, 2020

(54) IMAGE FORMING APPARATUS

(71) Applicant: CANON KABUSHIKI KAISHA, Tokyo (JP)

(72) Inventor: Takashi Nagaya, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/378,770

(22) Filed: Apr. 9, 2019

(65) Prior Publication Data

US 2019/0317444 A1 Oct. 17, 2019

(30) Foreign Application Priority Data

Apr. 13, 2018 (JP) ..... 2018-077384

(51) Int. Cl.
*G03G 15/00* (2006.01)

(52) U.S. Cl.
CPC ..... *G03G 15/556* (2013.01); *G03G 15/5016* (2013.01)

(58) Field of Classification Search
CPC ..... G03G 15/556; G03G 15/5016
See application file for complete search history.

(56) References Cited

U.S. PATENT DOCUMENTS 7,228,078 B2 * 6/2007 Okochi ..... G03G 15/553 399/13

FOREIGN PATENT DOCUMENTS

JP 2006-071905 A 3/2006
JP 2014174274 A * 9/2014 ..... G03G 15/0856

* cited by examiner

*Primary Examiner* — Susan S Lee
(74) *Attorney, Agent, or Firm* — Venable LLP

(57) ABSTRACT

An image forming apparatus including: an image forming unit; a replenishment mechanism; and a controller configured to control the replenishment mechanism, the controller controls, after a container that fails to satisfy a predetermined condition relating to a remaining amount of the developer is removed from an attaching portion, the image forming unit based on a mode of prohibiting an image from being formed based on a print job in a case where another container different from the removed container is attached to the attaching portion, and controls, after the container is removed from the attaching portion, a display to display a first screen for prompting reattachment of the container in the case where the another container is attached to the attaching portion, the first screen including a button that allows the mode to be canceled.

9 Claims, 11 Drawing Sheets

△ THE FOLLOWING COLOR TONER BOTTLE IS EMPTY.

YELLOW

PLEASE SET A NEW TONER BOTTLE.

FIG. 8

△ THE FOLLOWING COLOR TONER BOTTLE THAT CAN BE USED CONTINUOUSLY HAS BEEN REMOVED.

YELLOW

PLEASE RESET THE REMOVED TONER BOTTLE.
PLEASE COOPERATE IN ORDER TO MAKE EFFECTIVE USE OF LIMITED RESOURCES.

FIG. 9

△ THE FOLLOWING COLOR TONER BOTTLE THAT CAN BE USED CONTINUOUSLY HAS BEEN REPLACED.

YELLOW

PLEASE RESET THE REMOVED TONER BOTTLE.
PLEASE COOPERATE IN ORDER TO MAKE EFFECTIVE USE OF LIMITED RESOURCES.

CONTINUE THIS WAY

901

IMAGE FORMING APPARATUS

BACKGROUND OF THE INVENTION

Field of the Invention

The present disclosure relates to an image forming apparatus to which a container configured to contain a developer is detachably attachable.

Description of the Related Art

An electrophotographic image forming apparatus forms an image by developing an electrostatic latent image formed on a photosensitive member through use of a developer, which is a consumable, in a developing device. The developing device has a limit to an amount of a developer that can be stored therein. Therefore, the developing device is appropriately replenished with a developer from a container that is attachably and detachably provided to the image forming apparatus.

There is also a limit to an amount of a developer in the container. This inhibits the developing device from being replenished with a developer from the container when there is no developer remaining in the container. Thus, when there is no longer developer remaining in the container, the image forming apparatus notifies a user that the container requires replacement.

However, the user sometimes replaces the container even when there is a developer having an amount equal to or larger than a predetermined amount remaining in the container. In view of this, there is hitherto proposed an image forming apparatus configured to display a screen for warning that there is a developer remaining in the container when the container is removed before the container becomes empty (see Japanese Patent Application Laid-Open No. 2006-71905). According to this image forming apparatus, the user is notified that it is not the time to replace the container, and hence it is possible to inhibit the container in which a developer remains from being replaced.

As a usage form of the user, the image forming apparatus may be operated in an unattended manner at least temporarily when, for example, a large number of high density images are printed by a print job. Before such an unattended operation, the user may replace a container in which a developer still remains by a new container. In the following description, such a case is referred to as "replacement performed at some midpoint".

Such replacement performed at some midpoint aims at avoiding a situation in which the container becomes empty during the unattended operation so that the image formation is stopped at some midpoint of a print job. Assuming such a case, an investigation is being performed on a function of enabling image formation by permitting the user to replace the container at some midpoint even when a warning screen is displayed as in the related art.

Meanwhile, there is a demand that, when the replacement is performed at some midpoint, an original container replaced at some midpoint be reattached to use up its developer, for example, after an unattended operation is completed. This is for effective use of a consumable material.

However, in the related art, no guidance is made to reattach the original container in such a case, which inhibits the user from knowing necessity for reattaching the original container.

SUMMARY OF THE INVENTION

According to an embodiment, an image forming apparatus comprises:

an image forming unit configured to form an image with developer based on a print job;

an attaching portion to which a container containing developer for replenishing is to be attached;

a sensor configured to detect the developer in the image forming unit;

a replenishment mechanism configured to replenish the image forming unit with the developer for replenishing from the container attached to the attaching portion;

a display; and a controller configured to:

control the replenishment mechanism based on a detection result of the sensor;

control, after the container that fails to satisfy a predetermined condition relating to a remaining amount of the developer in the container is removed from the attaching portion, the image forming unit based on a mode of prohibiting the image from being formed based on the print job in a case where another container different from the removed container is attached to the attaching portion; and control, after the container that fails to satisfy the predetermined condition is removed from the attaching portion, the display to display a first screen for prompting reattachment of the removed container in a case where the another container different from the removed container is attached to the attaching portion, the first screen including a button that allows the mode to be canceled.

Further features of the present invention will become apparent from the following description of exemplary embodiments with reference to the attached drawings.

BRIEF DESCRIPTION OF THE DRAWINGS

FIG. 8 is a schematic diagram of a first warning screen.

FIG. 9 is a schematic diagram of a second warning screen.

DESCRIPTION OF THE EMBODIMENTS

Now, exemplary embodiments will be described in detail with reference to the drawings. Note that, components described in the embodiments are merely an example, and the scope of the present invention is not intended to be limited to only those embodiments.

In the following embodiments, as an example of the image forming apparatus, a copying machine, a printer, or other such image forming apparatus will be described. In the following description, like components are denoted by like reference symbols.

First Embodiment (Description of Image Forming Apparatus)

Figure 1:
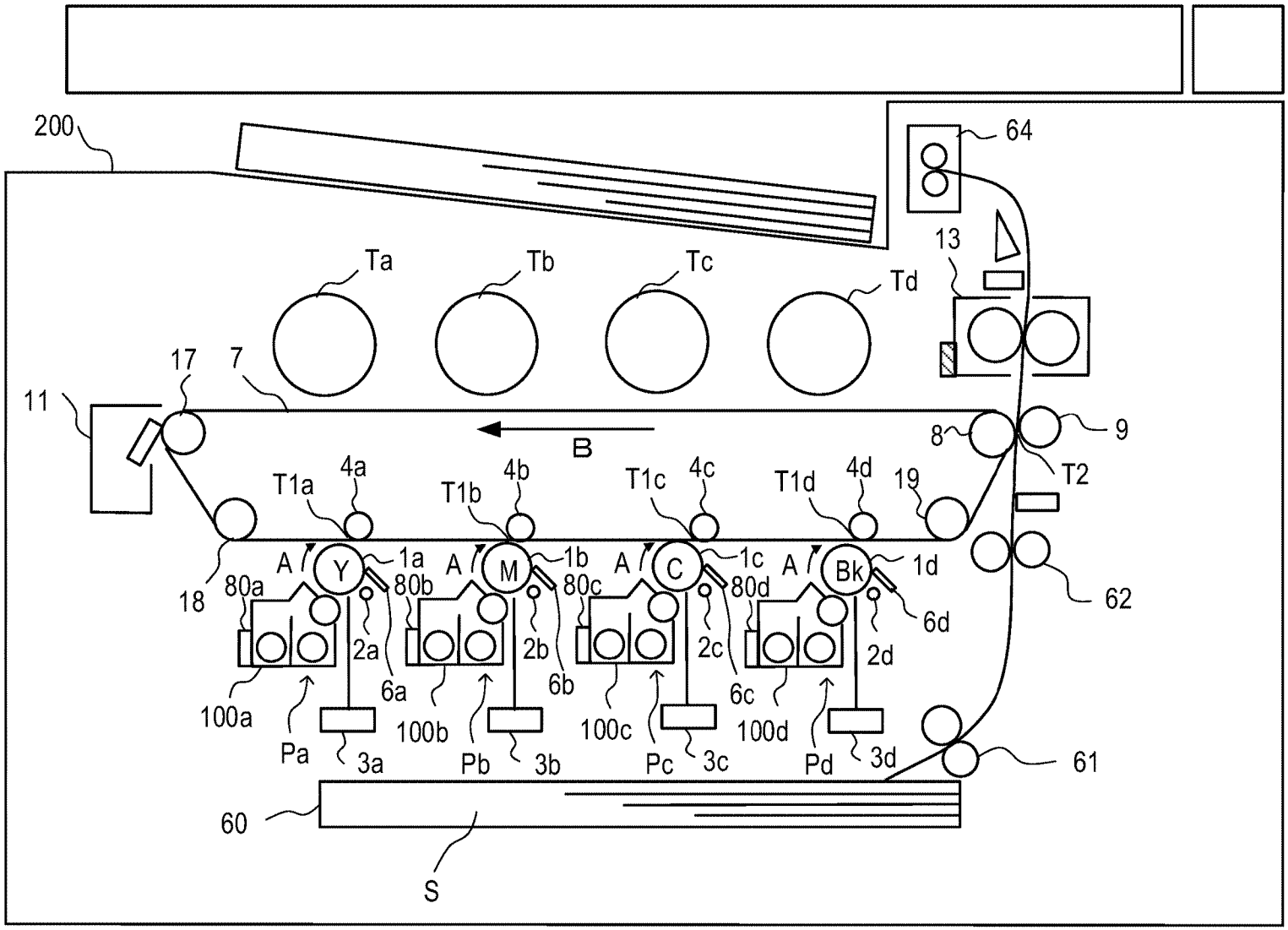
FIG. 1 is a schematic sectional view of an image forming apparatus.

FIG. 1 is a schematic sectional view of an image forming apparatus 200 according to a first embodiment. The image forming apparatus 200 includes four image forming portions Pa, Pb, Pc, and Pd configured to form toner images of respective color components, which are arranged side by side in a conveyance direction of an intermediate transfer belt 7. The image forming portion Pa forms a toner image of yellow. The image forming portion Pb forms a toner image of magenta. The image forming portion Pc forms a toner image of cyan. The image forming portion Pd forms a toner image of black.

Toner bottles Ta, Tb, Tc, and Td are attached to the image forming apparatus 200 as containers that are attachably and detachably provided to the image forming apparatus 200. The toner bottle Ta contains the toner of yellow. The toner bottle Tb contains the toner of magenta. The toner bottle Tc contains the toner of cyan. The toner bottle Td contains the toner of black. The toner bottles Ta, Tb, Tc, and Td each correspond to a container configured to contain a toner (developer serving as a consumable material or a consumable).

In the first embodiment, a case of employing an electrophotographic method as an image formation method for a printer engine and using a dry toner as a developer to be contained in a toner bottle is described as an example, but the embodiment is not limited thereto. For example, an ink jet method of ejecting ink to form an image on a sheet can also be employed as the image formation method. In this case, an ink cartridge serves as the container. In addition, a liquid developing method can also be employed as the image formation method. In this case, a liquid toner is contained in the container. The following description is directed to an example in which the developer contained in the container is a dry toner (hereinafter referred to simply as "toner").

The first embodiment is described by taking an exemplary case in which the toner bottle and an image forming portion serving as an image forming unit are separately attached to the image forming apparatus 200 as different consumable parts, but the embodiment is not limited thereto. For example, the image forming portion and the toner containing portion may be integrally formed as, for example, a so-called process cartridge.

The image forming portions Pa, Pb, Pc, and Pd have the same configuration. Therefore, the following description is directed to the image forming portion Pa configured to form the toner image of yellow, and descriptions relating to the other image forming portions Pb, Pc, and Pd are omitted.

The image formation portion Pa includes a photosensitive drum 1*a* having a photosensitive layer, which functions as a photosensitive member, on a surface of a metal roller, a charger 2*a* configured to charge the photosensitive drum 1*a*, and a developing device 100*a* configured to store a toner. The photosensitive drum 1*a* is rotated in a direction indicated by an arrow A. After the photosensitive drum 1*a* is charged by the charger 2*a*, a laser exposure device 3*a* exposes the photosensitive drum 1*a* based on image data on the color component of yellow. An electrostatic latent image having the color component of yellow is thus formed on the photosensitive drum 1*a*.

The developing device 100*a* uses the toner to develop the electrostatic latent image formed on the photosensitive drum 1*a*. A toner image is thus formed on the photosensitive drum 1*a*. The developing device 100*a* includes a toner density sensor 80*a* configured to detect an amount of the toner in the developing device 100*a*. When the toner density sensor 80*a* detects that the amount of the toner in the developing device 100*a* has decreased, the developing device 100*a* is supplied with the toner from the toner bottle Ta.

The image formation portion Pa includes a primary transfer roller 4*a* configured to transfer the toner image on the photosensitive drum 1*a* onto the intermediate transfer belt 7. A primary transfer voltage is applied to the primary transfer roller 4*a* while the toner image formed on the photosensitive drum 1*a* is passing through a primary transfer nip portion T1*a*, at which the photosensitive drum 1*a* and the intermediate transfer belt 7 are pressed against the primary transfer roller 4*a*. The toner image on the photosensitive drum 1*a* is thus transferred onto the intermediate transfer belt 7. The image formation portion Pa includes a drum cleaner 6*a* configured to remove the toner remaining on the photosensitive drum 1*a*.

The intermediate transfer belt 7 is stretched around a secondary transfer opposing roller 8, a driven roller 17, a first tension roller 18, and a second tension roller 19. The intermediate transfer belt 7 is rotated in a direction indicated by an arrow B by rotational drive of the secondary transfer opposing roller 8. In short, the toner image on the intermediate transfer belt 7 is conveyed in the direction indicated by the arrow B.

A secondary transfer roller 9 is arranged on a side opposite to the secondary transfer opposing roller 8 across the intermediate transfer belt 7. A secondary transfer voltage is applied to the secondary transfer opposing roller 8, to thereby cause the toner image on the intermediate transfer belt 7 to be transferred onto a recording material (sheet) S at a secondary transfer nip portion T2, at which the secondary transfer opposing roller 8 and the intermediate transfer belt 7 are pressed against the secondary transfer roller 9. A belt cleaner 11 removes the toner remaining on the intermediate transfer belt 7.

The recording material S onto which the toner image is to be transferred is contained in a cassette portion 60, and is fed from the cassette portion 60 by a sheet feeding roller (not shown). Conveyance rollers 61 convey the recording material S fed by the sheet feeding roller to registration rollers 62. After the recording material S is conveyed to the registration rollers 62, the registration rollers 62 convey the recording material S so as to bring the recording material S into contact with the toner image on the intermediate transfer belt 7.

After the toner image is transferred onto the recording material S by the secondary transfer roller 9, the recording material S is conveyed to the fixing portion 13. The fixing portion 13 includes a fixing roller including a heater, and a pressure roller, and fixes the toner image on the recording material S to the recording material S by heat generated by the heater and pressure applied between the fixing roller and the pressure roller. The recording material S to which the toner image has been fixed by the fixing portion 13 is delivered from the image forming apparatus 200 by delivery rollers 64.

(Image Forming Operation Performed by Image Forming Apparatus)

Next, an image forming operation in which the image forming apparatus 200 according to the first embodiment performs printing to generate printed matter based on image data on a print job transferred from, for example, a PC (not shown) or a scanner (not shown) is described.

The photosensitive drums 1*a*, 1*b*, 1*c*, and 1*d* start to be rotationally driven in the direction indicated by the arrow A. The chargers 2*a*, 2*b*, 2*c*, and 2*d* uniformly charge the surfaces of the photosensitive drums 1*a*, 1*b*, 1*c*, and 1*d*. The laser exposure devices 3*a*, 3*b*, 3*c*, and 3*d* expose the photosensitive drums 1*a*, 1*b*, 1*c*, and 1*d* based on the image data.

In this manner, the electrostatic latent images of the respective color components corresponding to the image data are formed on the photosensitive drums 1*a*, 1*b*, 1*c*, and 1*d*. At this time, the sheet feeding roller feeds the recording material S contained in the cassette portion 60, and the conveyance rollers 61 start to convey the recording material S to the registration rollers 62.

Next, the developing devices 100*a*, 100*b*, 100*c*, and 100*d* develop the electrostatic latent images on the photosensitive drums 1*a*, 1*b*, 1*c*, and 1*d*, to thereby form the toner images of the respective color components on the photosensitive drums 1*a*, 1*b*, 1*c*, and 1*d*. The toner images on the photosensitive drums 1*a*, 1*b*, 1*c*, and 1*d* are conveyed to the primary transfer nip portions T1*a*, T1*b*, T1*c*, and T1*d* in accordance with the rotation of the photosensitive drums 1*a*, 1*b*, 1*c*, and 1*d* in the direction indicated by the arrow A. At the primary transfer nip portions T1*a*, T1*b*, T1*c*, and T1*d*, the toner images of the respective color components on the photosensitive drums 1*a*, 1*b*, 1*c*, and 1*d* are transferred onto the intermediate transfer belt 7.

The primary transfer rollers 4*a*, 4*b*, 4*c*, and 4*d* transfer the toner images formed on the photosensitive drums 1*a*, 1*b*, 1*c*, and 1*d* onto the intermediate transfer belt 7. As a result, the toner image in full color is thus formed on the intermediate transfer belt 7. The toners remaining on the photosensitive drums 1*a*, 1*b*, 1*c*, and 1*d* are removed by the drum cleaners 6*a*, 6*b*, 6*c*, and 6*d*.

The registration rollers 62 adjust the timing to convey the recording material S to the secondary transfer nip portion T2 so that the toner image on the intermediate transfer belt 7 is to be transferred onto the recording material S at a desired position. The secondary transfer roller 9 causes the toner image on the intermediate transfer belt 7 to be transferred onto the recording material S at the secondary transfer nip portion T2. The toner remaining on the intermediate transfer belt 7 without being transferred onto the recording material S at the secondary transfer nip portion T2 is removed by the belt cleaner 11.

The recording material S bearing the toner image is conveyed to the fixing portion 13, and the fixing portion 13 fixes an unfixed toner image on the recording material S to the recording material S through melting. The recording material S that has passed through the fixing portion 13 is delivered from the image forming apparatus 200 by the delivery rollers 64. The image forming apparatus 200 can perform printing to generate printed matter based on the image data by the above-mentioned image forming operation.

(Configuration of Controller of Image Forming Apparatus)

Figure 2:
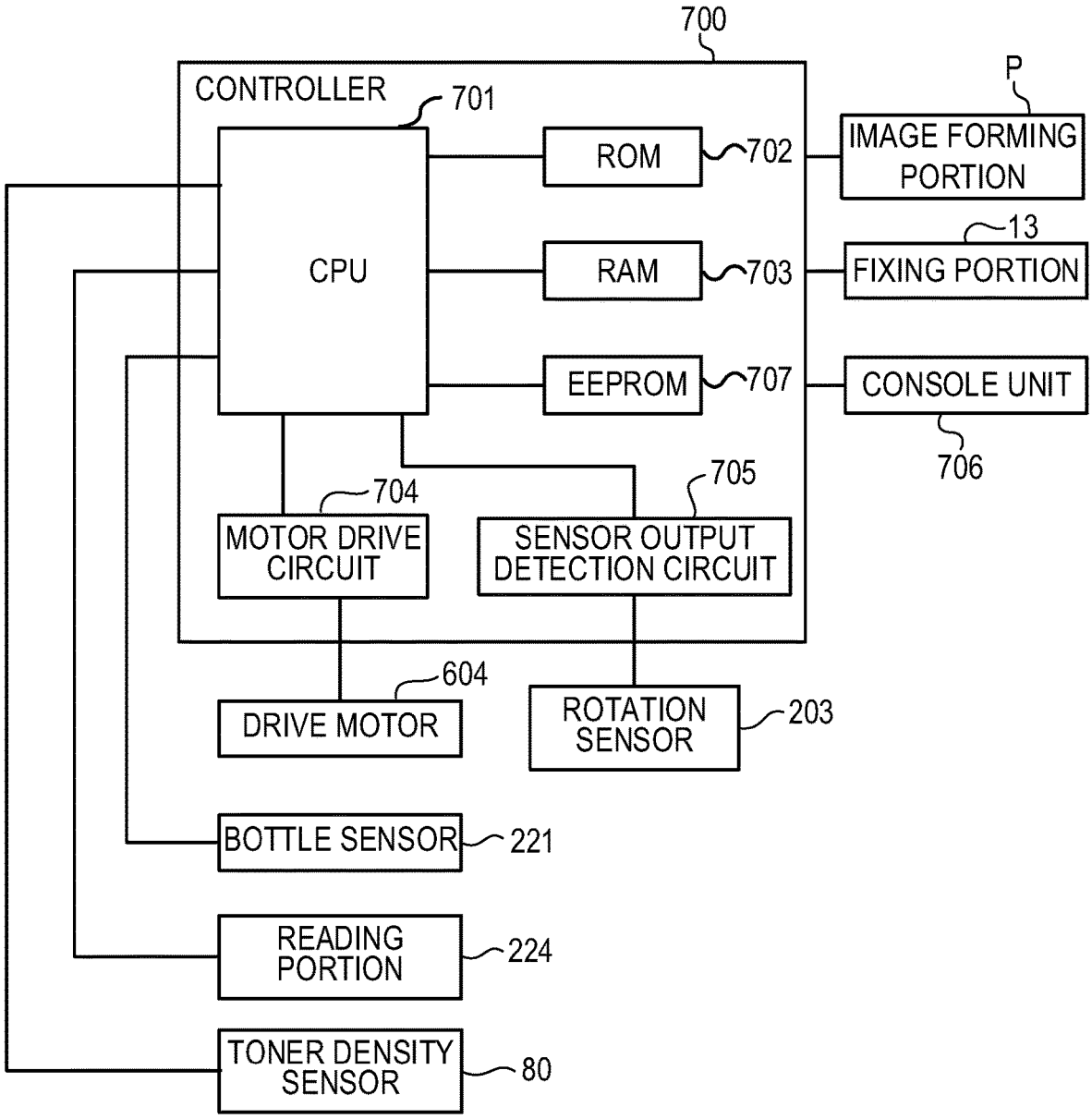
FIG. 2 is a control block diagram of the image forming apparatus.

FIG. 2 is a control block diagram of the image forming apparatus 200 according to the first embodiment. In the following description, the toner bottles Ta, Tb, Tc, and Td are generically referred to as "toner bottle T", and the developing devices 100*a*, 100*b*, 100*c*, and 100*d* are generically referred to as "developing device 100". In the same manner, the image forming portions Pa, Pb, Pc, and Pd are generically referred to as "image formation portion P", and the toner density sensor 80*a*, 80*b*, 80*c*, and 80*d* are generically referred to as "toner density sensor 80".

A controller 700 controls the entire image forming apparatus 200. The controller 700 includes a central processing unit (CPU) 701, a read only memory (ROM) 702, and a random access memory (RAM) 703. The controller 700 further includes an electrically erasable programmable ROM (EEPROM; hereinafter also referred to as "nonvolatile memory") 707, a motor drive circuit 704, and a sensor output detection circuit 705.

The CPU 701 is a control circuit serving as a controller configured to control each of the devices of the image forming apparatus 200. The ROM 702 stores a control program for controlling different kinds of processing, which is executed by the image forming apparatus 200. The RAM 703 is a system work memory to be used by the CPU 701 in order to execute the control program. The EEPROM 707 is a nonvolatile memory storage area, and holds its stored content even when the image forming apparatus 200 is powered off or when the image forming apparatus 200 enters a power saving mode. Examples of the data stored in the EEPROM 707 include a use status and a replacement history of the toner bottle T. The image formation portion P and the fixing portion 13 have been described with reference to FIG. 1, and hence descriptions thereof are omitted.

A bottle sensor 221 detects whether or not the toner bottle T has been attached to the image forming apparatus 200 at its attachment position, and outputs a result of the detection to the CPU 701.

The toner density sensor 80 outputs a signal corresponding to magnetic permeability that changes based on, for example, an amount of the toner in the developing device 100. The toner density sensor 80 is not limited to the sensor configured to output the signal corresponding to magnetic permeability that changes based on the amount of the toner in the developing device 100, and may be any sensor capable of detecting the amount of the toner in the developing device 100. The CPU 701 converts an output signal from the toner density sensor 80 into a toner density based on a conversion table (not shown). The CPU 701 performs control for replenishing the developing device 100 with a toner from the toner bottle T so that the toner density reaches a target density.

A console unit 706 includes a touch panel, and functions as a display portion being an image frame configured to display different kinds of screens and an input portion (input unit) configured to receive an instruction (information) as input from a user. The touch panel of the console unit 706 displays a home screen, a replacement screen, a discharge failure screen, and a warning screen based on signals from the CPU 701. The touch panel of the console unit 706 also notifies the user of a state of the image forming apparatus 200 based on a signal from the CPU 701. The configuration for displaying the above-mentioned screens is not limited to the touch panel, and may be, for example, a PC monitor connected to the image forming apparatus 200 through a network so as to enable communication therebetween.

A drive motor (replenishment mechanism) 604 is a drive source configured to rotate the toner bottle T in order to replenish the developing device 100 with a toner from the toner bottle T. To control the drive motor 604, the motor drive circuit 704 controls a current to be supplied to the drive motor 604. The CPU 701 sets a PWM value, which is a control value indicating a time ratio of the current to be supplied to the drive motor 604 per predetermined time period. The motor drive circuit 704 uses the PWM value to control the current to be supplied to the drive motor 604 based on the PWM value. In the first embodiment, a DC motor, for example, a DC brush motor is used as the drive motor 604. Therefore, a rotation speed of the drive motor 604 and a rotational drive force of the drive motor 604 vary based on the time ratio of the current to be supplied to the drive motor 604 per predetermined time period.

While the CPU 701 outputs an ENB signal, the motor drive circuit 704 can supply the current to the drive motor 604. That is, while the CPU 701 outputs the ENB signal, the motor drive circuit 704 supplies the current based on the PWM value to the drive motor 604, to thereby rotationally drive the toner bottle T. Meanwhile, when the CPU 701 stops outputting the ENB signal, the motor drive circuit 704 accordingly stops supplying the current to the drive motor 604, to thereby stop the rotation of the toner bottle T.

A rotation sensor 203 is an optical sensor including a light emitter and a light receiver, and outputs a signal corresponding to an amount of light received by the light receiver. While a predetermined region of the toner bottle T is passing through a detection position of the rotation sensor 203, the amount of light received by the rotation sensor 203 decreases below a threshold value. In contrast, while a region other than the predetermined region of the toner bottle T is passing through the detection position in a rotation direction in which the toner bottle T is rotated, the amount of light received by the rotation sensor 203 is equal to or larger than the threshold value. A specific configuration of the rotation sensor 203 is described later with reference to FIG. 4A, FIG. 4B, and FIG. 4C being schematic diagrams (side views) of a main portion of the toner bottle.

The sensor output detection circuit 705 outputs, based on an output signal from the rotation sensor 203, a high-level (logical 'H') signal when the amount of light received by the rotation sensor 203 is equal to or larger than the threshold value, and outputs a low-level (logical 'L') signal when the amount of received light is smaller than the threshold value. That is, the sensor output detection circuit 705 outputs a low-level signal while the predetermined region of the toner bottle T is passing through the detection position, and outputs a high-level signal while the region other than the predetermined region of the toner bottle T is passing through the detection position.

Figure 4A:
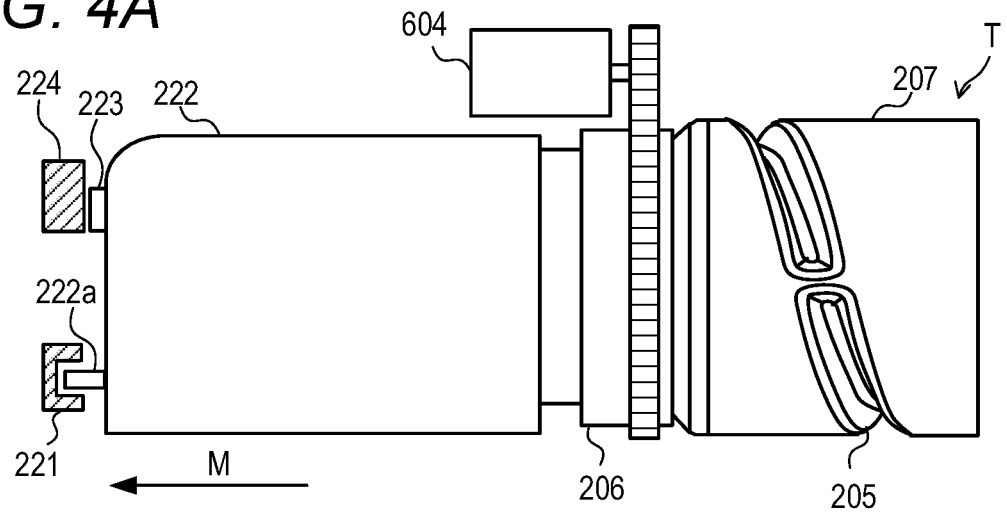
FIG. 4A, FIG. 4B, and FIG. 4C are schematic views of a main portion of a toner bottle.

A reading portion 224 reads replenishment information recorded in a memory 223, which is illustrated in FIG. 4A, of the toner bottle T attached at the attachment position of the image forming apparatus 200, and notifies the CPU 701 of the replenishment information. The reading portion 224 can also write the replenishment information notified by the CPU 701 to the memory 223 of the toner bottle T. The replenishment information includes, for example, a color of a toner contained in the toner bottle T, a uniquely assigned serial number of the toner bottle T, a replenishment history of the toner bottle T, and a toner empty flag of the toner bottle T. The replenishment history of the toner bottle T is, for example, the number of revolutions (cumulative value of the number of revolutions) of the toner bottle T. The CPU 701 causes the reading portion 224 to record the information on the number of revolutions of the toner bottle T in the memory 223 each time the toner bottle T is rotated by one rotation. The number of revolutions of the toner bottle T corresponds to the number of times that the toner bottle is replenished. The toner empty flag of the toner bottle T is a flag indicating a so-called empty ("out-of-toner" described later) state, in which the developing device 100 is not replenished with the toner even when the toner bottle T is rotated.

The motor drive circuit 704, the sensor output detection circuit 705, the rotation sensor 203, the bottle sensor 221, and the reading portion 224 are provided for each color of the toner. The drive motor 604 is also provided for each color of the toner. However, the drive motor 604 may be configured so that, for example, a plurality of toner bottles T are rotated by a single drive motor. One drive motor 604 can selectively rotate the plurality of toner bottles T as long as a clutch is configured to control the state of the image forming apparatus 200 between a state in which a drive force can be transmitted from the drive motor 604 to the toner bottle T and a state in which the drive force cannot be transmitted from the drive motor 604 to the toner bottle T.

(Configuration of Attaching Portion of Image Forming Apparatus)

Figure 3A:
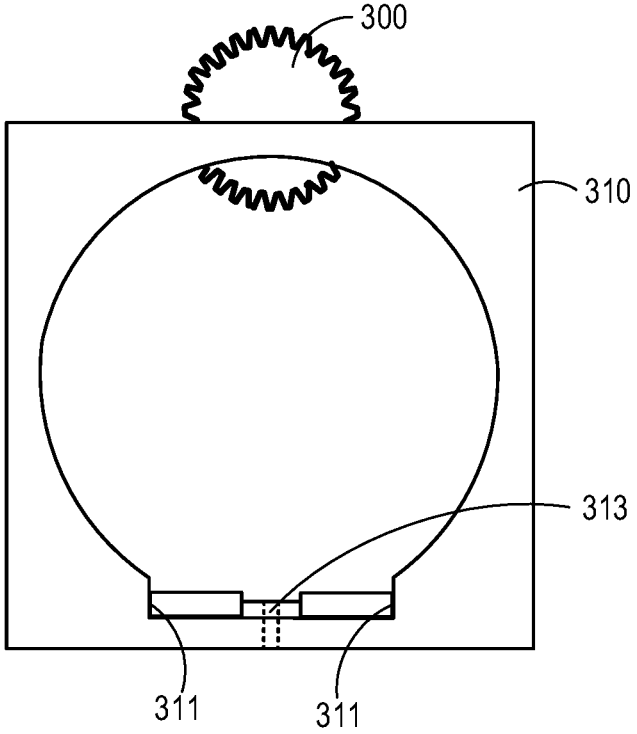
FIG. 3A and FIG. 3B are schematic views of a main portion of an attaching portion of the image forming apparatus.
Figure 3B:
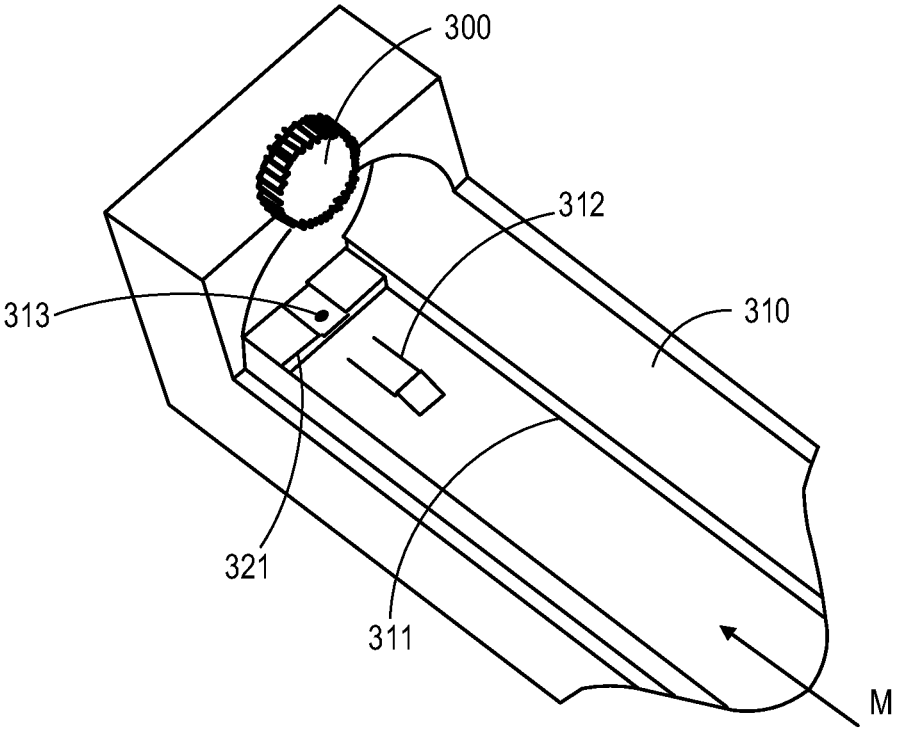

With reference to FIG. 3A and FIG. 3B, a configuration of an attaching portion 310 provided to the image forming apparatus 200, to which the toner bottle T is to be attached, is described. FIG. 3A is a partial front view of the attaching portion 310 as viewed from the front in a direction of attaching the toner bottle T, and FIG. 3B is a perspective view for illustrating the inside of the attaching portion 310 on one end side. As illustrated in FIG. 3B, the toner bottle T is attached to the attaching portion 310 in a direction indicated by an arrow M. The direction indicated by the arrow M is parallel with a direction of a rotation axis of each of the photosensitive drums 1*a*, 1*b*, 1*c*, and 1*d* of the image forming apparatus 200. Further, a direction of removing the toner bottle T from the attaching portion 310 is a direction reverse to the direction indicated by the arrow M.

The attaching portion 310 includes a driving gear 300, a rotation regulation portion 311 configured to regulate a cap portion 222, which is illustrated in FIG. 4A, of the toner bottle T so as not to be rotated in accordance with the rotation of the toner bottle T, a bottom portion 321, and a movement regulation portion 312. The movement regulation portion 312 is engaged with the cap portion 222 of the toner bottle T, to thereby regulate the movement of the cap portion 222 along a direction of a rotation axis thereof. An inlet (inlet hole) 313 is formed to the bottom portion 321. When the toner bottle T is attached, the inlet 313 communicates to an outlet (discharging hole) 211, which is illustrated in FIG. 4B, of the toner bottle T to receive the toner discharged from the toner bottle T.

The toner discharged from the outlet 211 of the toner bottle T passes through the inlet 313 to be supplied to the developing device 100. In the first embodiment, the diameter of the inlet 313 is the same as that of the outlet 211, and is, for example, about 2 (mm). The driving gear 300 transmits a rotational drive force from the drive motor 604 to the toner bottle T attached to the attaching portion 310.

(Configuration of Toner Bottle)

Figure 4B:
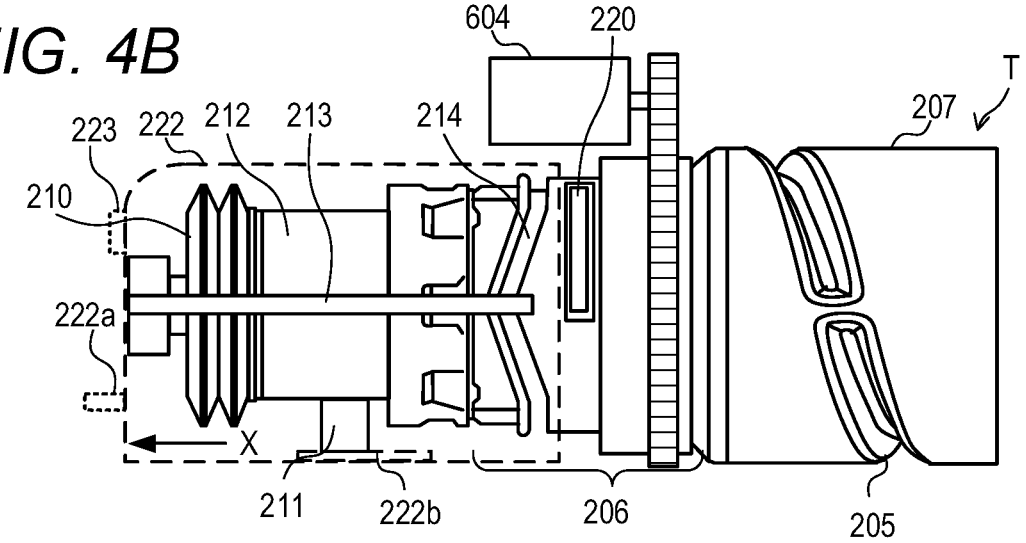
Figure 4C:
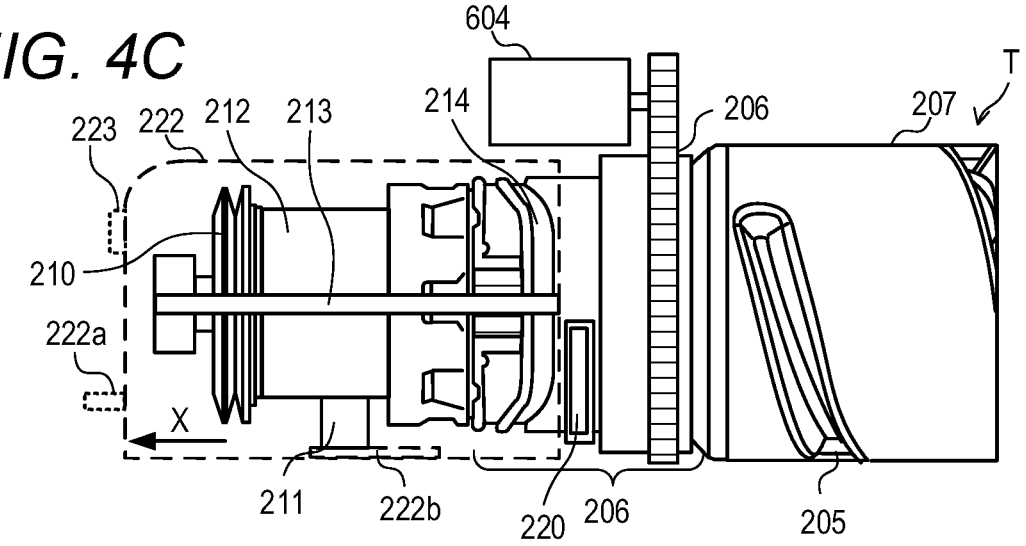

With reference to FIG. 4A, FIG. 4B and FIG. 4C, a configuration of the toner bottle T is described. FIG. 4A is an external view of the toner bottle T attached to the attaching portion 310. FIG. 4B and FIG. 4C are sectional views of a main portion, in each of which an internal structure of the cap portion 222 of the toner bottle T attached to the attaching portion 310 is illustrated.

The toner bottle T includes a containing portion 207 configured to contain a toner, a drive transmission portion 206, to which a rotational drive force is to be transmitted from the drive motor 604, a discharge portion 212 including the outlet 211 for discharging the toner, and a pump portion 210 for discharging the toner in the discharge portion 212 from the outlet 211. The toner bottle T further includes a reciprocating member 213 configured to expand and contract the pump portion 210. The drive transmission portion 206 includes a protruding portion 220 and a cam groove 214. The cam groove 214 is formed around the drive transmission portion 206 by one round in a rotation direction in which the drive transmission portion 206 of the toner bottle T is rotated.

The cam groove 214 and the protruding portion 220 formed to the drive transmission portion 206 are rotated integrally with the drive transmission portion 206. The drive motor 604 transmits the rotational drive force to the drive transmission portion 206 of the toner bottle T via the driving gear 300, to thereby rotate the drive transmission portion 206 of the toner bottle T and the containing portion 207 coupled to the drive transmission portion 206. A protruding portion 205 is helically formed in the inside of the containing portion 207, and causes the toner inside the containing portion 207 to be conveyed to the outlet 211 in accordance with the rotation of the containing portion 207.

Meanwhile, the cap portion 222 has the rotation regulated by the attaching portion 310, and is therefore inhibited from being rotated even when the drive transmission portion 206 is rotated. The outlet 211, the pump portion 210, and the reciprocating member 213 are also regulated so as not to be rotated along with the cap portion 222. Therefore, even when the drive transmission portion 206 is rotated, the outlet 211, the pump portion 210, and the reciprocating member 213 are not rotated.

A rotation regulation groove is formed inside the cap portion 222. The rotation regulation groove regulates the reciprocating member 213 so as not to be rotated when the drive transmission portion 206 is rotated. The reciprocating member 213 is engaged with the rotation regulation groove. The reciprocating member 213 is also coupled to the pump portion 210, and a claw portion (not shown) is engaged with the cam groove 214 of the drive transmission portion 206. With this configuration, in accordance with the rotation of the drive transmission portion 206, the reciprocating member 213 moves along the cam groove 214 while being regulated so as not to be rotated, and therefore reciprocates in a direction indicated by an arrow X (longitudinal direction of the toner bottle T).

With reciprocation of the reciprocating member 213, the pump portion 210 repeats expansion and contraction alternately. That is, the reciprocating member 213 is moved in the direction indicated by the arrow X, to thereby expand the pump portion 210. The expansion of the pump portion 210 lowers an inner pressure in the toner bottle T, and causes air to be taken in from the outlet 211, to thereby loosen the toner in the discharge portion 212. Subsequently, the movement of the reciprocating member 213 in a direction reverse to the direction indicated by the arrow X causes the pump portion 210 to be contracted. Then, the contraction of the pump portion 210 increases the pressure in the toner bottle T, and the toner deposited at the outlet 211 is supplied from the outlet 211 to the developing device 100 through a toner conveyance path. In this manner, the drive motor 604 functions as a drive portion configured to rotate the toner bottle T attached to the attaching portion 310, to thereby expand and contract the pump portion 210 in accordance with the rotational drive of the toner bottle T.

The cap portion 222 includes a projection 222*a* on the rear side in the direction (direction indicated by the arrow M) of attaching the toner bottle T. The bottle sensor 221 provided to the image forming apparatus 200 detects that the toner bottle T has been attached to the attaching portion 310 illustrated in FIG. 3A. That is, when the toner bottle T has been attached at the attachment position, the bottle sensor 221 detects the projection 222*a* of the cap portion 222, and outputs a signal indicating that the toner bottle T has been attached to the CPU 701 illustrated in FIG. 2. The bottle sensor 221, the projection 222*a*, and other such components function as a container detection unit.

In addition, the memory 223, in which information relating to the toner bottle T is recorded, is attached to the cap portion 222. The CPU 701 causes the reading portion 224 to communicate to/from the memory 223 to read the replenishment information on the toner bottle T. The CPU 701 causes the reading portion 224 to write the information on the number of revolutions of the toner bottle T to the memory 223 each time the toner bottle T is rotated by one rotation.

The cap portion 222 also includes a sealing member 222*b* configured to seal the outlet 211. When the outlet 211 is sealed with the sealing member 222*b*, it is possible to prevent the toner in the toner bottle T from leaking out of the outlet 211. The user removes the sealing member 222*b* before the toner bottle T is attached to the attaching portion 310, to thereby release the outlet 211 of the toner bottle T.

FIG. 4B is the sectional view of the main portion of the toner bottle T, in which the pump portion 210 of the toner bottle T is expanded to a maximum, and FIG. 4C is the sectional view of the main portion of the toner bottle T, in which the pump portion 210 of the toner bottle T is contracted to a maximum. The pump portion 210 is a bellows-like pump made of resin, which is variable in capacity in accordance with its own expansion and contraction motion. That is, the pump portion 210 is formed of "mountain-fold" portions and "valley-fold" portions arranged alternately and repeatedly along the longitudinal direction of the toner bottle T.

In the first embodiment, a replenishment operation is performed two times while the toner bottle T is rotated by one round. One round of the replenishment operation for the toner starts with a state in which the pump portion 210 is contracted to a maximum, followed by expansion and another contraction of the pump portion 210, and ends with a state in which the pump portion 210 is contracted to a maximum again.

The cam groove 214 is formed to have two peak portions and two valley regions in order of "valley→peak→valley→peak". While a position of the cam groove 214 engaged with the reciprocating member 213 is changed from the valley to the peak, the pump portion 210 is being expanded to a maximum. Then, while the position of the cam groove 214 engaged with the reciprocating member 213 is changed from the peak to the valley, the pump portion 210 is being contracted to a maximum. When the position of the cam groove 214 engaged with the reciprocating member 213 is at the valley, the pump portion 210 maintains the state of being contracted to a maximum.

(Configuration of Rotation Sensor)

Next, the rotation sensor 203 provided to the image forming apparatus 200 is described with reference to FIG. 5A and FIG. 5B each being a schematic diagram (front view) of the main portion of the toner bottle. The rotation sensor 203 is the optical sensor including the light emitter and the light receiver configured to receive light emitted from the light emitter. The flag 204 is brought into contact with the drive transmission portion 206 illustrated in FIG. 4A of the toner bottle T due to its self-weight. Therefore, the flag 204 is lifted up by the protruding portion 220 of the drive transmission portion 206 to swing about a rotary shaft 204*a*, to thereby block the light from the light emitter. In short, it can be detected by the rotation sensor 203 whether or not the flag 204 is in contact with the protruding portion 220. This allows the rotation sensor 203 to detect a rotation position of the toner bottle T.

Figure 5A:
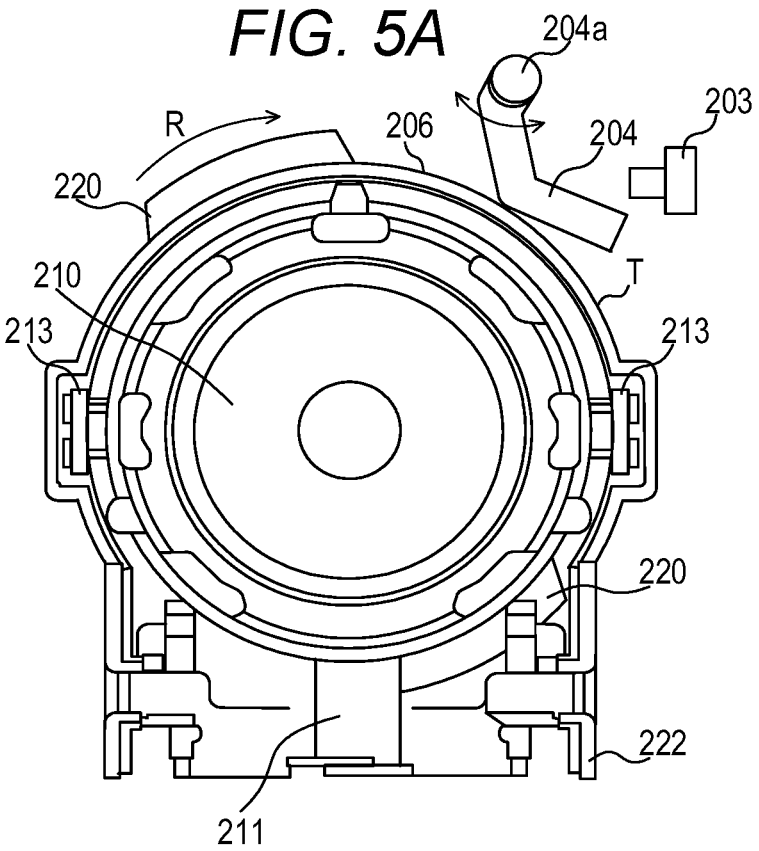
FIG. 5A and FIG. 5B are schematic views of a main part of a flag sensor.

FIG. 5A is an illustration of a state in which the flag 204 is brought into abutment with a region (another region) overlapping with a region in which the protruding portion 220 is formed in the direction of attaching the toner bottle T and being different from the protruding portion 220 in a rotation direction R of rotating the drive transmission portion 206. In this case, the flag 204 is not located at a position between the light emitter and the light receiver, and hence the light receiver can receive the light emitted from the light emitter.

In the first embodiment, unless the flag 204 is located at the position between the light emitter and the light receiver, the amount of light received by the light receiver becomes equal to or larger than the threshold value. In this case, the sensor output detection circuit 705 illustrated in FIG. 2 outputs a high-level signal when the amount of light received by the light receiver is equal to or larger than the threshold value, and outputs a low-level signal when the amount of light received by the light receiver is smaller than the threshold value. In short, when the flag 204 is in contact with a region other than the protruding portion 220, the sensor output detection circuit 705 outputs a high-level signal to the CPU 701.

Figure 5B:
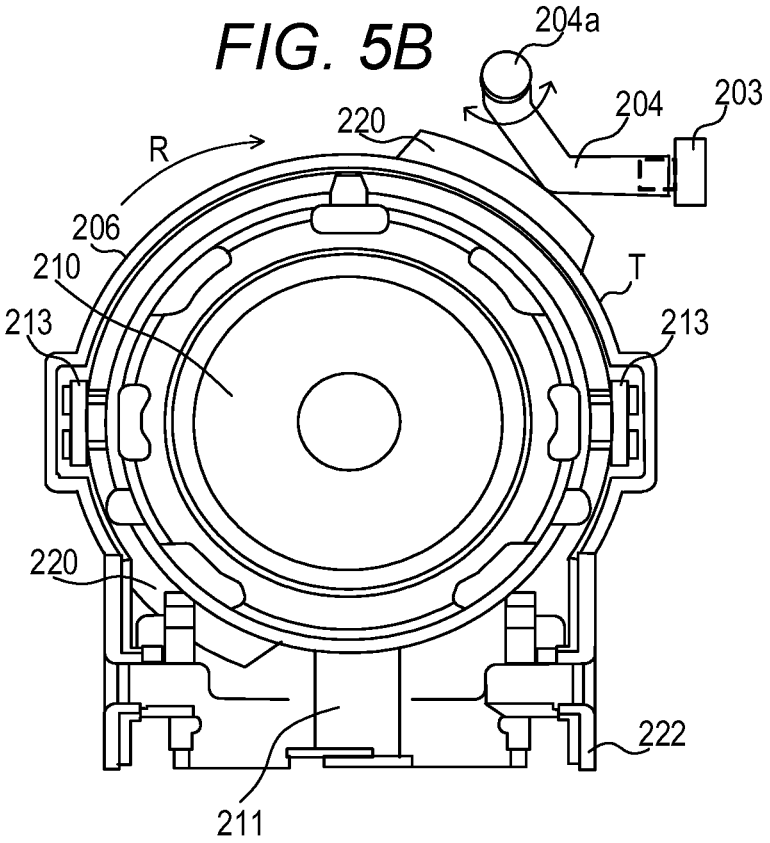

Meanwhile, FIG. 5B is an illustration of a state in which the flag 204 is brought into abutment with the protruding portion 220. In this case, the flag 204 is located at the position between the light emitter and the light receiver. Therefore, the light receiver cannot receive the light emitted from the light emitter, and the amount of light received by the light receiver becomes smaller than the threshold value. That is, when the flag 204 is in contact with the protruding portion 220, the sensor output detection circuit 705 outputs a low-level signal to the CPU 701.

In this case, in the first embodiment, the pump portion 210 starts to be expanded after an output signal from the sensor output detection circuit 705 is changed from a low level to a high level. While the output signal from the sensor output detection circuit 705 maintains a high level, the pump portion 210 is being expanded to a maximum and then starts to be contracted. Then, before the output signal from the sensor output detection circuit 705 is changed from a high level to a low level, the pump portion 210 shifts to the state of being contracted to a maximum.

It has been found from experiments that the amount (replenishment amount) of the toner with which the developing device 100 is replenished from the toner bottle T is a value corresponding to a speed with which the inner pressure in the toner bottle T changes. It has also been found that a decrease in weight of the toner bottle T increases the rotation speed of the toner bottle T. In view of this, in the first embodiment, a position in a starting state is designed so as to stabilize a target rotation speed before the pump portion 210 starts to be expanded. In other words, a position in an ending state of the previous replenishment with the toner is designed.

In addition, in the first embodiment, the rotation speed of the toner bottle T is feedback controlled, to thereby reduce a change in rotation speed of the toner bottle T in accordance with a change in weight of the toner bottle T. In order to perform the feedback control with high precision, it is important to measure the rotation speed of the toner bottle T with high precision. The DC motor (DC brush motor) has characteristics of taking much time for a rise to reach the target rotation speed and for a stop. Therefore, it is required to detect the timing at which the DC motor is stabilized at the target rotation speed, and to measure the rotation speed at the detected timing.

In the first embodiment, the DC motor is designed so as to be stabilized at the target rotation speed before the pump portion 210 starts to be expanded. Therefore, the rotation speed of the toner bottle T is measured during a period after the pump portion 210 is expanded until the pump portion 210 is contracted.

In addition, the cam groove 214 has a valley region wider than its peak region so that the rotation of the toner bottle T is stopped under the state in which the pump portion 210 is contracted to a maximum. This reduces the possibility that the rotation is stopped under the state in which the pump portion 210 is not contracted to a maximum.

(Out-of-Toner Detection Sequence)

An out-of-toner detection sequence in the first embodiment is described with reference to FIG. 6.

Figures 6, 7:
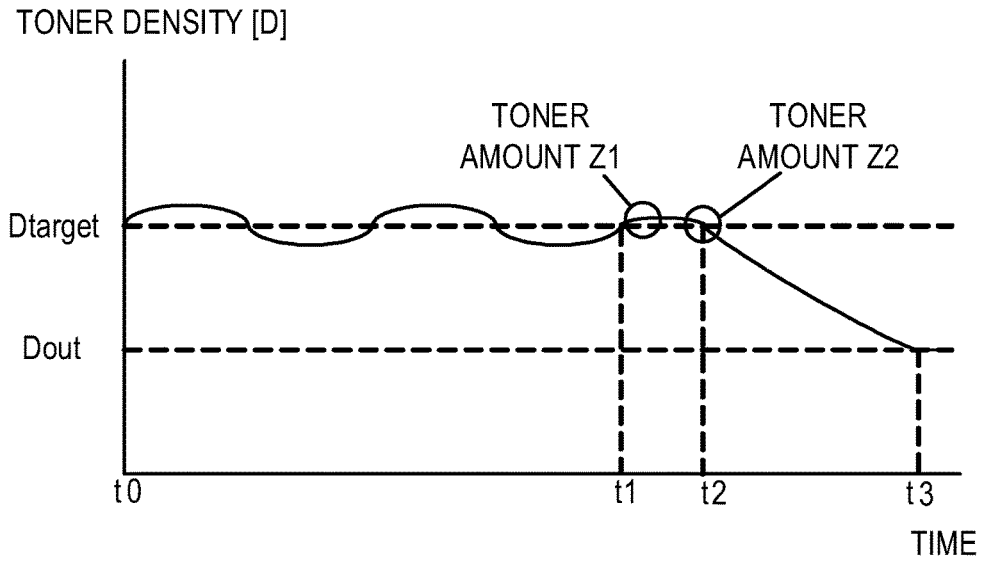
FIG. 6 is a schematic graph for showing a transition of a toner density in the developing device.
FIG. 7 is a schematic diagram of a replacement screen.

FIG. 6 is a schematic graph for showing a transition of the toner density in the developing device 100. The CPU 701 illustrated in FIG. 2 performs the control for replenishing the developing device 100 with a toner from the toner bottle T so that the toner density detected by the toner density sensor 80 illustrated in FIG. 1 reaches a target toner density Dtarget. The CPU 701 acquires an output value from the toner density sensor 80, for example, every 10 msec.

When a state in which a toner density D detected by the toner density sensor 80 is smaller than the target toner density Dtarget has continued over a predetermined time period, for example, 500 msec, the CPU 701 controls the drive motor 604 to rotate the toner bottle T. With this configuration, the developing device 100 is replenished with the toner from the toner bottle T, to thereby increase the toner density D detected by the toner density sensor 80. That is, the CPU 701 functions as a controller configured to control the drive motor 604 so that an amount of a developer in the developing device 100 reaches a target amount.

A remaining amount of the toner in the developing device 100 decreases during image formation. Therefore, the CPU 701 replenishes the developing device 100 with the toner from the toner bottle T each time the state in which the toner density D is smaller than the target toner density Dtarget has continued over 500 msec. As shown in a period from a time t0 to a time t2 in FIG. 6, the toner density D in the developing device 100 is controlled at the target toner density Dtarget.

When the remaining amount of the toner in the toner bottle T falls below a predetermined amount Z1, the amount of the toner with which the developing device 100 is replenished from the toner bottle T considerably decreases. Therefore, as shown in a period from a time t1 to the time t2 in FIG. 6, the toner density D in the developing device 100 increases little. When the remaining amount of the toner in the toner bottle T then falls below a predetermined amount Z2, which is smaller than the predetermined amount Z1 (at the time t2), the developing device 100 is not replenished with the toner in spite of the rotation of the toner bottle T.

Therefore, when the remaining amount of the toner in the toner bottle T falls below the predetermined amount Z2, the remaining amount of the toner in the developing device 100 keeps decreasing while the image forming apparatus 200 is executing the image forming operation. That is, as shown in a period from the time t2 to a time t3 in FIG. 6, the toner density D in the developing device 100 keeps decreasing, and the toner density D falls below a threshold value Dout at the time t3.

In the first embodiment, the CPU 701 stops the image forming operation when the toner density D detected by the toner density sensor 80 falls below the threshold value Dout. Then, the CPU 701 controls the drive motor 604 illustrated in FIG. 2 to execute a squeeze-out process. The squeeze-out process refers to a process for controlling drive of the drive motor 604 so that a replenishment amount exhibited when the developing device 100 is replenished from the toner bottle T becomes larger than a replenishment amount in a normal replenishment operation. In the squeeze-out process, for example, the CPU 701 repeats such an operation five times as to rotate the toner bottle T by four rounds and then stop the rotation for two seconds. The squeeze-out process corresponds to a predetermined replenishment operation.

When the remaining amount of the toner in the toner bottle T is equal to or larger than a predetermined amount Z2, the toner density D in the developing device 100 is supposed to increase while the squeeze-out process is being executed. The CPU 701 determines that the remaining amount of the toner in the toner bottle T is smaller than the predetermined amount Z2 even when the toner density D does not reach the target toner density Dtarget in spite of the execution of the squeeze-out process. That is, the CPU 701 determines that the toner bottle T satisfies a replacement condition for the toner bottle T under the "out-of-toner" state. In addition, the CPU 701 records the toner empty flag indicating the "out-of-toner" state in the memory 223 of the toner bottle T. Therefore, the CPU 701 functions as a determination unit configured to determine whether or not the container satisfies the replacement condition.

FIG. 7 is a schematic diagram of an example of the replacement screen displayed on the touch panel of the console unit 706 after it is thus determined that the remaining amount of the toner in the toner bottle T is smaller than the predetermined amount Z2 in the "out-of-toner" state (out-of-toner detection). In the first embodiment, as the determination of being in the "out-of-toner" state, it is assumed based on the detected remaining amount that the toner in the container cannot be used continuously, to thereby satisfy the replacement condition for the toner bottle T. The replacement screen functions as a screen for notifying (informing) the user that there is out-of-toner of a specific color in the toner bottle T, and that it is required to replace the toner bottle T by a new toner bottle T.

The user follows an instruction on the replacement screen to remove the toner bottle T from the attaching portion 310 and attach a new toner bottle T to the attaching portion 310. When the bottle sensor 221 illustrated in FIG. 2 detects that a new toner bottle T has been attached after detecting that the toner bottle T was removed, the CPU 701 erases the replacement screen. When the toner bottle T is replaced, the home screen is displayed on the touch panel of the console unit 706.

The CPU 701 may be configured to erase the replacement screen when determining that the newly-attached toner bottle T is different from the removed toner bottle T based on the serial number unique to the toner bottle T.

The home screen is a screen different from the replacement screen, the discharge failure screen, and the warning screen. The home screen is, for example, a screen that allows the user to change print settings of the image forming apparatus 200. For example, the home screen allows the user to set the number of print sheets, a density of the printed matter, and a print mode.

Immediately after the toner bottle T is replaced, the toner density D in the developing device 100 is lower than the target toner density Dtarget, and hence the CPU 701 controls the drive motor 604 to execute the replenishment with the toner. Then, after the toner density D in the developing device 100 exceeds the target toner density Dtarget, the image forming apparatus 200 becomes able to execute the image forming operation.

(Midpoint Removal Warning Sequence)

A midpoint removal warning sequence in the first embodiment is described.

The toner bottle T is sometimes removed before the above-mentioned replacement screen illustrated in FIG. 7 is displayed. In such a case, the amount of the toner in the removed toner bottle T is equal to or larger than the predetermined amount (Z2), and hence a warning for prompting the user to reattach the removed original toner bottle T is issued. Such a midpoint removal warning sequence is described below with reference to the control block diagram illustrated in FIG. 2 and a flow chart illustrated in FIG. 10.

The toner bottle removed under the state in which the amount of the toner in the toner bottle is equal to or larger than the predetermined amount (Z2), that is, the state in which the replacement condition is not satisfied, is referred to as "toner bottle removed at some midpoint".

A program operating on the image forming apparatus 200 illustrated in the following flow chart is stored in, for example, the ROM 702 in the controller 700 illustrated in FIG. 2, and is read into the RAM 703 to be executed by the CPU 701. This applies to other flowcharts described below. In the following description, the symbol "S" indicates a step.

Figure 10:
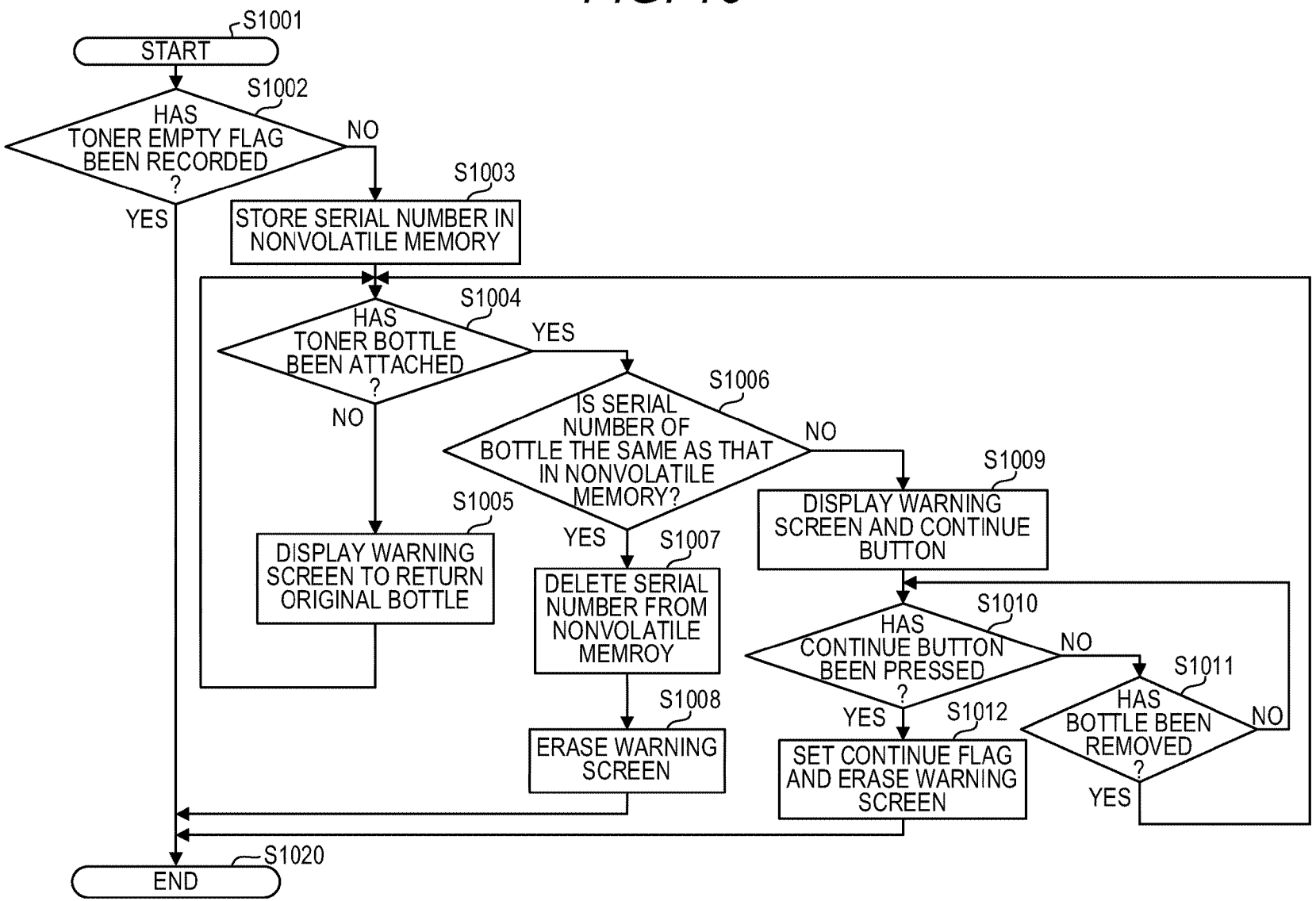
FIG. 10 is a flow chart for illustrating control to be performed on a warning display screen when the toner bottle is removed in a first embodiment.

In Step S1001, the CPU 701 starts the flow chart illustrated in FIG. 10 when the bottle sensor 221 detects that the toner bottle T has been removed. In Step S1002, the CPU 701 first determines whether or not a toner empty flag has been recorded in the replenishment information read from the memory 223 of the toner bottle T.

When the toner empty flag has been recorded, the CPU 701 advances the processing to Step S1020 to bring the warning sequence to an end. This is because it is not required to prompt the user to reattach the removed toner bottle T in a toner empty state.

Meanwhile, when the toner empty flag has not been recorded, in Step S1003, the CPU 701 stores, in the non-volatile memory 707, a serial number included in the replenishment information read from the memory 223 of the removed toner bottle T, and advances the processing to Step S1004.

In Step S1004, the CPU 701 determines whether or not the toner bottle T has been attached, that is, whether or not the attachment has been detected by the bottle sensor 221. The CPU 701 advances the processing to Step S1006 when determining that the attachment of the toner bottle T has been detected, and advances the processing to Step S1005 when determining that the attachment has not been detected.

In Step S1005, the CPU 701 displays, on the console unit 706, a first warning screen illustrated in FIG. 8 for prompting the user to restore, namely, reattach the removed original toner bottle T, and returns the processing to Step S1004.

Meanwhile, in Step S1006, the CPU 701 displays the warning screen illustrated in FIG. 8, and also reads the serial number from the memory 223 of the attached toner bottle to compare the read serial number with the serial number stored in the nonvolatile memory 707. The CPU 701 advances the processing to Step S1007 when determining that the serial numbers are the same, and advances the processing to Step S1009 when determining that the serial numbers are different from each other.

In this case, the serial numbers being the same means that the attached toner bottle is a toner bottle removed before, and does not satisfy the replacement condition for the toner bottle with the amount of the remaining toner being equal to or larger than the predetermined amount (Z2 in this case). Meanwhile, the serial numbers being different from each other means that the attached toner bottle is a new toner bottle.

In Step S1007, the CPU 701 determines that the toner bottle removed before has been reattached, deletes the serial number stored in the nonvolatile memory 707, and advances the processing to Step S1008. In Step S1008, the CPU 701 erases the display of the warning screen illustrated in FIG. 8, and advances the processing to Step S1020 to bring the warning sequence to an end.

Meanwhile, in Step S1009, the CPU 701 determines that a new toner bottle has been attached, and displays a second warning screen illustrated in FIG. 9 on the console unit 706 in place of the warning screen illustrated in FIG. 8. The second warning screen includes a message for prompting the user to restore, namely, reattach the removed original toner bottle T and a continue button 901. The continue button 901 is a button for instructing to execute (continue or start) the print job with a newly attached toner bottle.

Subsequently, in Step S1010, the CPU 701 determines whether or not the continue button 901 has been pressed. When determining that the continue button 901 has been pressed, in Step S1012, the CPU 701 sets a continue flag, stores the continue flag in the nonvolatile memory 707, erases the display of the second warning screen, and advances the processing to Step S1020 to bring the warning sequence to an end. In this case, the continue flag is a flag indicating that, when a new toner bottle was attached in place of the toner bottle that does not satisfy the replacement condition, it was instructed by the user to continue or start the print job using the new toner bottle.

Meanwhile, when determining that the continue button 901 has not been pressed, the CPU 701 determines in Step S1011 whether or not the removal of the toner bottle has been detected by the bottle sensor 221. The CPU 701 returns the processing to Step S1004 when determining that the toner bottle has been removed, and returns the processing to Step S1010 when determining that the toner bottle is still attached. In other words, when the user has not pressed the continue button 901 and has not removed the toner bottle, the CPU 701 continues to prohibit the image formation based on the print job. This is referred to as "prohibition mode".

The CPU 701 displays the above-mentioned home screen after erasing the display of the second warning screen on the touch panel of the console unit 706 in Step S1008 and Step S1012.

In the flow chart illustrated in FIG. 10, the CPU 701 may be configured to display only the second warning screen illustrated in FIG. 9 in Step S1009 without displaying the warning screen illustrated in FIG. 8 in Step S1006. In that case, the processing of Step S1008 is not required.

(First Re-warning Sequence)

A first re-warning sequence in the first embodiment is described.

The first re-warning sequence is performed to issue a warning for prompting the user to reattach the original toner bottle T after completion of processing for the print job executed after the continue button 901 is pressed in the above-mentioned midpoint removal warning sequence. Such a first re-warning sequence is described below with reference to the control block diagram illustrated in FIG. 2 and the flow chart illustrated in FIG. 11.

After the processing illustrated in FIG. 10, in Step S1401, the CPU 701 first determines whether or not the continue flag is set in the nonvolatile memory 707. When determining that the continue flag is set, the CPU 701 starts the processing of the flow chart illustrated in FIG. 11, and advances the processing to Step S1402.

In Step S1402, the CPU 701 determines whether or not the print job has been started. When determining that the print job has been started, the CPU 701 advances the processing to Step S1403. The print job is started in response to an operation performed through the console unit 706 or an instruction from a network interface (not shown).

In Step S1403, the CPU 701 determines whether or not the print job has been ended. When determining that the print job has been ended, the CPU 701 advances the processing to Step S1404.

In Step S1404, the CPU 701 determines whether or not the toner bottle T has been attached, that is, whether or not the attachment has been detected by the bottle sensor 221. The CPU 701 advances the processing to Step S1406 when determining that the attachment of the toner bottle T has been detected, and advances the processing to Step S1405 when determining that the attachment has not been detected.

In Step S1405, the CPU 701 displays, on the console unit 706, the first warning screen illustrated in FIG. 8 for prompting the user to restore, namely, reattach the removed original toner bottle T, and returns the processing to Step S1004.

Meanwhile, in Step S1406, the CPU 701 displays the warning screen illustrated in FIG. 8, and also reads the serial number from the memory 223 of the attached toner bottle to compare the read serial number with the serial number stored in the nonvolatile memory 707. The CPU 701 advances the processing to Step S1407 when determining that the serial numbers are the same, and advances the processing to Step S1409 when determining that the serial numbers are different from each other.

In Step S1407, the CPU 701 determines that the toner bottle removed before has been reattached, deletes the serial number and the continue flag stored in the nonvolatile memory 707, and advances the processing to Step S1408. In Step S1408, the CPU 701 erases the display of the warning screen illustrated in FIG. 8, and advances the processing to Step S1420 to bring the first re-warning sequence to an end.

Meanwhile, in Step S1409, the CPU 701 determines that a new toner bottle has been attached, and displays the second warning screen illustrated in FIG. 9 on the console unit 706 in place of the warning screen illustrated in FIG. 8.

Subsequently, in Step S1410, the CPU 701 determines whether or not the continue button 901 on the second warning screen has been pressed. When determining that the continue button 901 has been pressed, in Step S1412, the CPU 701 erases the display of the second warning screen, and returns the processing to Step S1402.

Meanwhile, when determining that the continue button 901 has not been pressed, the CPU 701 determines in Step S1411 whether or not the removal of the toner bottle has been detected by the bottle sensor 221. The CPU 701 returns the processing to Step S1404 when determining that the toner bottle has been removed, and returns the processing to Step S1410 when determining that the toner bottle is still attached.

The CPU 701 displays the above-mentioned home screen after erasing the display of the second warning screen on the touch panel of the console unit 706 in Step S1408.

By thus executing the first re-warning sequence, guidance is made to replace the original toner bottle after the completion of the processing for the print job even when the toner bottle is replaced at some midpoint. Therefore, the user can be made aware of necessity for an operation for restoring the original toner bottle, which allows effective use of the developer serving as a consumable.

Figure 11:
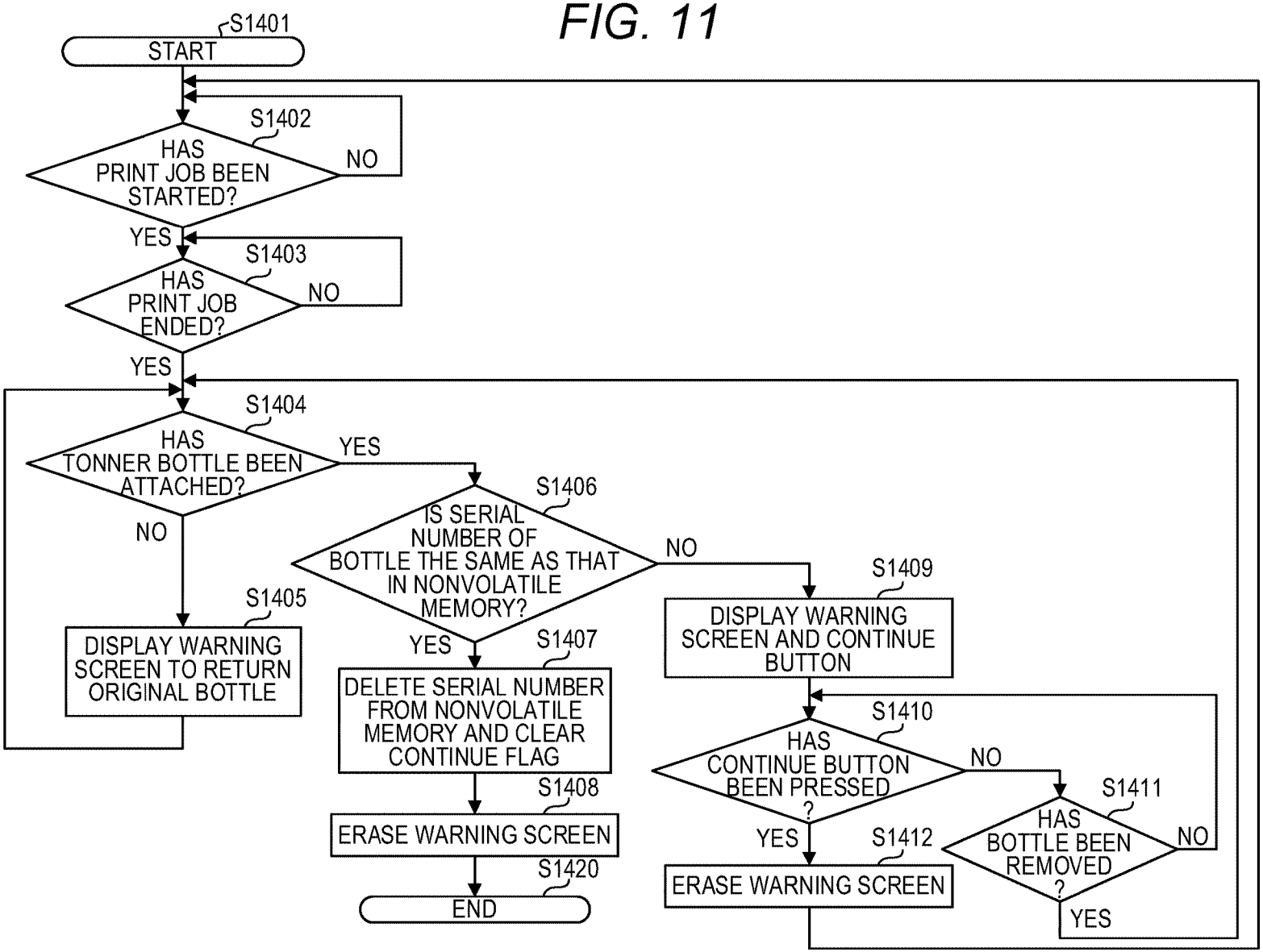
FIG. 11 is a flow chart for illustrating control to be performed on a re-warning display screen in the first embodiment.

In the flow chart illustrated in FIG. 11, the CPU 701 may be configured to display only the second warning screen illustrated in FIG. 9 in Step S1409 without displaying the warning screen illustrated in FIG. 8 in Step S1406. In that case, the processing of Step S1408 is not required.

Second Embodiment

It is preferred to replace the toner bottle after the developer is used up from the viewpoint of use of resources. However, due to a malfunction of the toner bottle (for example, a mechanical failure in the toner bottle), it is sometimes required to forcibly replace the toner bottle at some midpoint.

In a case where the toner bottle is replaced at some midpoint for such a reason, the warning screen keeps being displayed unless the original bottle is restored when the warning screen illustrated in FIG. 9 is displayed in the first re-warning sequence described in the first embodiment.

In view of this, in order to avoid such a situation, in a second embodiment, the following second re-warning sequence is executed in place of the first re-warning sequence, to thereby allow the user to cancel the display of the warning screen through the user's operation.

Now, the second re-warning sequence in the second embodiment is described.

In the first re-warning sequence described above, a warning is issued to prompt the user to reattach the original toner bottle T after completion of processing for the print job executed after the continue button 901 is pressed. The second re-warning sequence is performed in order to allow the further display of the warning to be canceled or prohibited in such a case. Such a second re-warning sequence is described below with reference to the control block diagram illustrated in FIG. 2 and a flow chart illustrated in FIG. 12.

Figure 12:
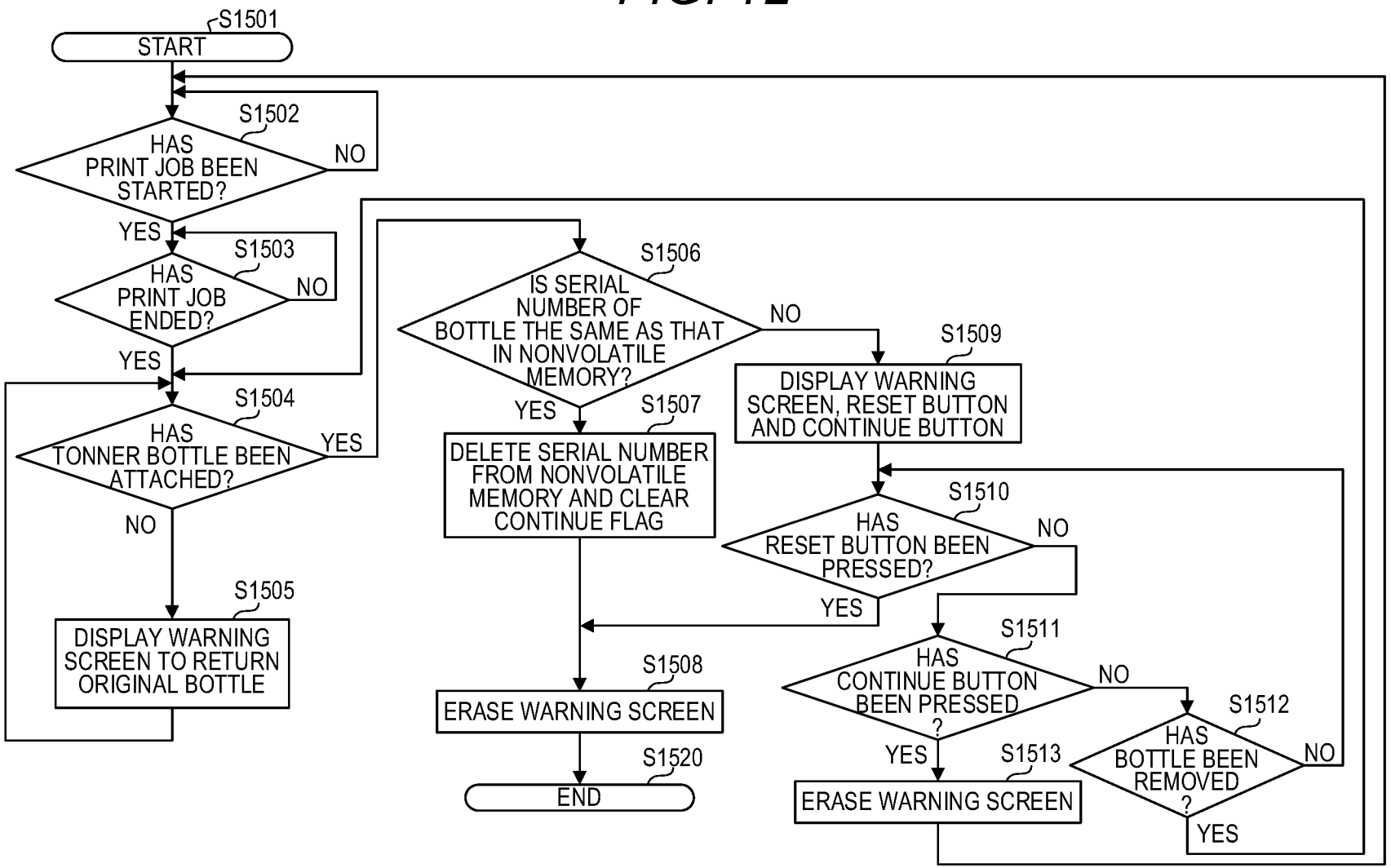
FIG. 12 is a flow chart for illustrating control to be performed on a re-warning display screen in a second embodiment.

In this case, the processing of Step S1501 to Step S1508 and Step S1520 illustrated in FIG. 12 is the same as the processing of Step S1401 to Step S1408 and Step S1420 illustrated in FIG. 11, respectively, and hence descriptions of those processing steps are omitted. In Step S1506, the CPU 701 displays the warning screen illustrated in FIG. 8, and when determining that the serial number of the attached toner bottle and the serial number stored in the nonvolatile memory 707 are different from each other, the CPU 701 advances the processing to Step S1509.

Figure 13:
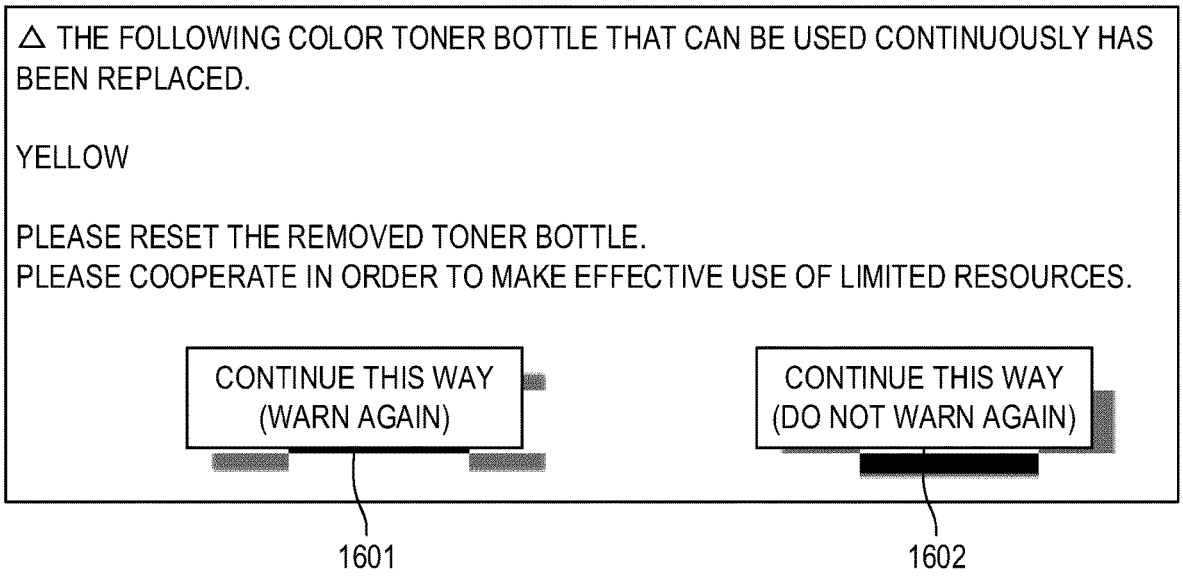
FIG. 13 is a schematic diagram for illustrating a third warning screen.

In Step S1509, the CPU 701 determines that a new toner bottle has been attached, and displays a third warning screen illustrated in FIG. 13 on the console unit 706 in place of the warning screen illustrated in FIG. 8. The third warning screen includes a message for prompting the user to restore, namely, reattach the original toner bottle T removed at some midpoint, a continue button 1601, and a reset button 1602.

The continue button 1601 is a button for instructing to execute (continue or start) the print job with a newly attached toner bottle and instructing to permit re-display of the warning screen for prompting the user to restore the original toner bottle removed at some midpoint. Meanwhile, the reset button 1602 is a button for instructing to execute (continue or start) the print job with a newly attached toner bottle and instructing to prohibit or cancel the re-display of the warning screen for prompting the user to restore the original toner bottle removed at some midpoint.

Subsequently, in Step S1510, the CPU 701 determines whether or not the reset button 1602 on the third warning screen has been pressed. When determining that the reset button 1602 has been pressed, the CPU 701 advances the processing to Step S1507 and Step S1508 to perform the same processing as Step S1407 and Step S1408 illustrated in FIG. 11, and then advances the processing to Step S1520 to bring the second re-warning sequence to an end. With this configuration, when the reset button 1602 has been pressed, it is possible to prohibit or cancel the re-display of the warning screen for prompting the user to restore the original toner bottle removed at some midpoint.

Meanwhile, when determining that the reset button 1602 has not been pressed, the CPU 701 advances the processing to Step S1511.

In Step S1511, the CPU 701 determines whether or not the continue button 1601 on the third warning screen has been pressed. When determining that the continue button 1601 has been pressed, in Step S1513, the CPU 701 erases the display of the third warning screen, and returns the processing to Step S1502.

Meanwhile, when determining that the continue button 1601 has not been pressed, the CPU 701 determines in Step S1512 whether or not the removal of the toner bottle has been detected by the bottle sensor 221. The CPU 701 returns the processing to Step S1504 when determining that the toner bottle has been removed, and returns the processing to Step S1510 when determining that the toner bottle is still attached.

The CPU 701 displays the above-mentioned home screen after erasing the display of the third warning screen on the touch panel of the console unit 706 in Step S1508.

By thus executing the second re-warning sequence, it is possible to prohibit or cancel the display of the warning screen when the toner bottle is replaced at some midpoint for a compelling reason, for example, due to a malfunction of the toner bottle.

In the flow chart illustrated in FIG. 12, the CPU 701 may be configured to display only the third warning screen illustrated in FIG. 13 in Step S1509 without displaying the warning screen illustrated in FIG. 8 in Step S1506. In that case, the processing of Step S1508 is not required.

Modification Example

In each of the above-mentioned embodiments, the serial number of only the toner bottle removed first at some midpoint is stored in the nonvolatile memory 707, but when there are a plurality of toner bottles removed at some midpoint, it is possible to store serial numbers of those toner bottles. With such a configuration, it is possible to make guidance to replace the toner bottle by any one of those plurality of toner bottles removed at some midpoint.

In that case, serial numbers or other such IDs unique to the plurality of toner bottles removed at some midpoint may be displayed on the warning screen in the form of a list. In addition to the serial numbers, information on the colors of the plurality of toner bottles removed at some midpoint is stored in the nonvolatile memory 707. In view of this, among the plurality of toner bottles removed at some midpoint, the serial numbers of the toner bottles having the same colors as those of newly-attached toner bottles may be displayed on the warning screen in the form of a list.

In each of the above-mentioned embodiments, the message for prompting the user to perform the reattachment is displayed on the warning screen displayed on the console unit 706, but instead or simultaneously, the user may be informed of the message by, for example, sound emitted from a speaker. In this case, the console unit 706 and the speaker function as a notifying portion (notifying unit) configured to inform the user of the message.

In addition to each of the above-mentioned embodiments, the CPU 701 may be configured to inform the user of the message when the image forming apparatus is powered on after being powered off after the continue button 901 or 1601 is pressed and the print job is ended. That is, the CPU 701 may be configured to prompt the user to restore the original toner bottle when the power is turned on without waiting for the start and end of the processing for a new print job.

The CPU 701 may also be configured to inform the user of the message when the image forming apparatus recovers a normal state after entering a sleep state (power saving state) after the continue button 901 or 1601 is pressed and the print job is ended. That is, the CPU 701 may be configured to prompt the user to restore the original toner bottle when the normal state is recovered without waiting for the start and end of the processing for a new print job.

Specifically, the CPU 701 may be configured to start the flow chart from Step S1404 or Step S1504 when the image forming apparatus is powered on or when the normal state is recovered from the sleep state in a case where the continue flag is set in FIG. 11 or FIG. 12. Therefore, the print job is executed in Step S1410 or Step S1511 after the continue button 901 or 1601 is pressed in Step S1402 or Step S1502.

The user may also be prompted to restore the original toner bottle when the power is turned off at some midpoint during the print job due to some reason and is then turned on or when the sleep state is entered at some midpoint during the print job and the normal state is then recovered.

As described above, according to one embodiment, the image forming apparatus includes the image forming units (Pa, Pb, Pc, and Pd) each configured to perform printing of image data based on a print job through use of a consumable (toner or other such developer) contained in the container (toner bottle). The image forming apparatus further includes the determination unit (CPU 701) configured to determine whether or not the container satisfies the replacement condition, the notifying unit (706) configured to inform the user of the message, the controller (CPU 701, Step S1004 to Step S1006, and Step S1009), and the input unit. When the container is removed without being determined to satisfy the replacement condition by the determination unit, the controller causes the notifying unit to inform the user of a first message illustrated in FIG. 8 and FIG. 9 for prompting the user to reattach the removed container. The input unit (706 or 901 and Step S1010) allows the user to input information in response to the message. The controller causes the notifying unit to inform the user of a second message illustrated in FIG. 9 for prompting the user to reattach the removed container (Step S1409 or Step S1509) in the following case: the printing of the image data based on the print job is performed after, under a state in which another container is attached in place of the removed container, an instruction to execute the print job using the another container is input by the user through the input unit (Step S1010).

The case in which the printing of the image data based on the print job is performed includes not only a case in which the printing of the image data based on the print job is ended based on the instruction to execute the print job, but also a case in which the image forming apparatus is powered on again after being powered off after the completion of the printing.

The case in which the printing of the image data based on the print job is performed also includes a case in which the image forming apparatus is powered on after the printing of the image data based on the print job is ended based on the instruction to execute the print job. That is, the case in which the printing of the image data based on the print job is performed also includes a case in which the power is turned off at some midpoint during the print job due to some reason and is then turned on and when the sleep state is entered at some midpoint during the print job and the normal state is then recovered.

According to the image forming apparatus configured in the above-mentioned manner, when, under a state in which a container having a consumable remaining therein has been replaced by another container, an instruction to execute a print job using the another container is input by a user and image formation is performed, the user is informed to restore the original container. Therefore, the user can be made aware of the necessity for the operation for restoring the original container, which prevents a developer serving as a consumable from being disposed of without being used, to thereby allow the effective use of the consumable.

According to the above-mentioned embodiments, when, under a state in which a container having a developer remaining therein has been replaced by another container, an instruction to execute a print job using the another container is input by a user and image formation is performed, the user is informed to reattach the original container. Therefore, the user can be made aware of the necessity for the operation for restoring the original container, which prevents a developer serving as a consumable from being disposed of without being used, to thereby allow the effective use of the developer.

In the above-mentioned embodiments, the image forming apparatus configured to use the toner or other such developer as the consumable to print an image on a sheet is described as an example, but the embodiment is not limited thereto. For example, the embodiment can be applied to the replacement of a container in a 3D printer configured to use resin, metal, or other such consumable contained in the container to generate a three-dimensional object, or other such image forming apparatus.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-077384, filed Apr. 13, 2018, which is hereby incorporated by reference herein in its entirety.

What is claimed is:

1. An image forming apparatus comprising:

an image forming unit configured to form an image with developer based on a print job;

an attaching portion to which a container containing developer for replenishing is attached;

a sensor configured to detect the developer in the image forming unit;

a replenishment mechanism configured to replenish the image forming unit with the developer for replenishing from the container attached to the attaching portion;

a display; and a controller configured to:

control the replenishment mechanism based on a detection result of the sensor;

control, after the container that fails to satisfy a predetermined condition relating to a remaining amount of the developer in the container is removed from the attaching portion, the image forming unit based on a mode of prohibiting the image from being formed based on the print job in a case where another container different from the removed container is attached to the attaching portion; and control, after the container that fails to satisfy the predetermined condition is removed from the attaching portion, the display to display a first screen for prompting reattachment of the removed container in the case where the another container different from the removed container is attached to the attaching portion, the first screen including a button that allows the mode to be canceled.

2. The image forming apparatus according to claim 1, wherein the controller is configured to control the display to display a second screen for prompting the reattachment of the removed container after the image forming unit completes forming the image based on the print job by the mode being canceled.

3. The image forming apparatus according to claim 1, wherein the controller is configured to determine whether the predetermined condition is satisfied based on a number of times that the image forming unit is replenished with the developer from the container.

4. The image forming apparatus according to claim 1, wherein the replenishment mechanism is configured to replenish the image forming unit with the developer by rotating the container, and wherein the controller is configured to determine whether the predetermined condition is satisfied based on a number of revolutions of the container.

5. The image forming apparatus according to claim 1, wherein the controller is configured to control the display to display another screen different from the first screen in a case where the removed container is reattached to the attaching portion after the first screen is displayed on the display.

6. The image forming apparatus according to claim 1, wherein the controller is configured to control the display to hide the first screen in a case where the removed container is reattached to the attaching portion after the first screen is displayed on the display.

7. The image forming apparatus according to claim 1, wherein the controller is configured to control the display to display another screen for prompting replacement of the container attached to the attaching portion in a case where another predetermined condition relating to the remaining amount of the developer in the image forming unit is satisfied.

8. The image forming apparatus according to claim 7, wherein the controller is configured to determine whether the another predetermined condition is satisfied based on the detection result of the sensor.

9. The image forming apparatus according to claim 1, wherein the controller is configured to control the display to display another screen for prompting the reattachment of the removed container in a case where the container that fails to satisfy the predetermined condition is removed from the attaching portion.

* * * * *